US007691238B2

(12) United States Patent
Billings

(10) Patent No.: US 7,691,238 B2
(45) Date of Patent: Apr. 6, 2010

(54) SPIRAL FABRICS

(75) Inventor: Alan L. Billings, Clifton Park, NY (US)

(73) Assignee: Albany International Corp., Albany, NY (US)

( * ) Notice: Subject to any disclaimer, the term of this patent is extended or adjusted under 35 U.S.C. 154(b) by 292 days.

(21) Appl. No.: 11/820,772

(22) Filed: Jun. 20, 2007

(65) Prior Publication Data

US 2008/0050587 A1 Feb. 28, 2008

Related U.S. Application Data

(63) Continuation-in-part of application No. 11/012,512, filed on Dec. 15, 2004, now Pat. No. 7,575,659.

(51) Int. Cl.
*D21F 1/10* (2006.01)

(52) U.S. Cl. ..... 162/348; 162/903; 428/222; 428/401

(58) Field of Classification Search ..... 162/348, 162/358.2, 900, 902, 903; 139/383 A, 425 A; 28/110, 142; 29/435; 245/6; 474/206, 208; 198/850–853; 428/222, 371, 397, 401; 34/95, 34/116, 123
See application file for complete search history.

(56) References Cited

U.S. PATENT DOCUMENTS

| | | | | |
|---|---|---|---|---|
| 4,345,730 | A * | 8/1982 | Leuvelink | 245/6 |
| 4,346,138 | A | 8/1982 | Lefferts | |
| 4,362,776 | A | 12/1982 | Lefferts et al. | |
| 4,381,612 | A | 5/1983 | Shank | |
| 4,415,625 | A | 11/1983 | Borel | |
| 4,502,595 | A | 3/1985 | Wheeldon | |
| 4,567,077 | A | 1/1986 | Gauthier | |
| 4,579,771 | A * | 4/1986 | Finn et al. | 428/222 |
| 4,583,302 | A | 4/1986 | Smith | |
| 4,662,994 | A | 5/1987 | Lord | |
| 4,839,213 | A | 6/1989 | Gauthier | |
| 5,104,724 | A | 4/1992 | Hsu | |

(Continued)

FOREIGN PATENT DOCUMENTS

| | | |
|---|---|---|
| DE | 33 01 041 A | 7/1984 |

(Continued)

OTHER PUBLICATIONS

International Search Report and Written Opinion issued by European Patent Office on Aug. 22, 2008 for corresponding international application PCT/US2008/066691.

*Primary Examiner*—Eric Hug
(74) *Attorney, Agent, or Firm*—Frommer Lawrence & Haug LLP; Ronald R. Santucci

(57) ABSTRACT

A spiral-link fabric for use in a papermaking machine or the like. The spiral-link fabric may include a plurality of spiral coils arranged in a predetermined manner such that adjacent ones of side-by-side spiral coils are interdigitated with each other so as to form a channel and interconnected by a pintle extending through the channel. At least some of the plurality of spiral coils have a coil width of approximately 12 mm or larger, as measured in machine direction of the spiral-link fabric. The ratio of the diameter of the monofilament forming the spiral coils to the coil width may be approximately 0.07 or less.

27 Claims, 3 Drawing Sheets

U.S. PATENT DOCUMENTS

| | | | | |
|---|---|---|---|---|
| 5,115,582 | A | | 5/1992 | Westhead |
| H1073 | H | * | 7/1992 | Hsu ..... 162/348 |
| 5,240,763 | A | | 8/1993 | Wagner et al. |
| 5,364,692 | A | | 11/1994 | Bowen, Jr. et al. |
| 5,514,456 | A | | 5/1996 | Lefferts |
| 5,534,333 | A | | 7/1996 | Keller et al. |
| 6,332,480 | B1 | | 12/2001 | Best |
| H2081 | H | | 9/2003 | Lee |
| 2006/0124268 | A1 | | 6/2006 | Billings |

FOREIGN PATENT DOCUMENTS

| | | | |
|---|---|---|---|
| DE | 39 29 310 | A | 3/1991 |
| EP | 0 190 732 | A | 8/1986 |
| FR | 2 064 159 | | 7/1971 |
| FR | 2 064 159 | A | 7/1971 |

* cited by examiner

SPIRAL FABRICS

CROSS-REFERENCE TO RELATED APPLICATION

This application is a continuation-in-part of U.S. patent application Ser. No. 11/012,512, now U.S. Pat. No. 7,575,659, filed Dec. 15, 2004.

BACKGROUND OF THE INVENTION

1. Field of the Invention

The present invention relates to spiral fabrics. More specifically, the present invention relates to spiral-link fabrics having coils with relatively low monofilament diameter to width ratio utilized on a papermaking machine and other industrial applications.

2 . Description of the Related Art

During the papermaking process, a cellulosic fibrous web is formed by depositing a fibrous slurry, that is, an aqueous dispersion of cellulose fibers, onto a moving forming fabric in a forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric.

For example, because of the solid support beams for dryer sections, all dryer fabric must have a seam. Installation of the fabric includes pulling the fabric body onto a machine and joining the fabric ends to form an endless belt. The seam region of any workable fabric must behave in use as close to the body of the fabric in order to prevent the periodic marking by the seam region of the paper product being manufactured.

A fabric may be formed completely of spiral coils (so called "spiral-link fabric") as taught by Gauthier, U.S. Pat. No. 4,567,077; which is incorporated herein by reference. In such a fabric, cross-machine direction ("CD") rows of spiral coils are connected to each other by at least one connecting pin, pintle or the like. The coils are wound or formed on a mandrel of a monofilament having a specific diameter 60. The coils, as shown for example in FIG. 4, have a major dimension (coil width) 50 and a minor dimension (coil thickness) 100. The coil width as referred to herein is actually the length of the coil as measured in the machine direction ("MD") of the spiral-link fabric in use. Once the coil is in fabric form, the calculated fabric thickness or caliper, therefore, would be equal to twice the diameter of the monofilament that form the spiral coils plus the pintle diameter.

Actual measured values may, however, be higher dependent on the processing and finishing options used.

In theory, the seam can be at any location in the fabric body where a connecting pin may be removed. Spiral-link fabrics offer a number of advantages over traditional fabric. For example, the seam of a spiral-link fabric is geometrically similar to the fabric body, and thus is less likely to mark the paper sheet. In addition, spiral-link fabrics may withstand flattening, thus imparting constant permeability to fluids (in particular air) which would otherwise pass therethrough. Due to these advantageous features, spiral-link fabrics are used in papermaking machines, particularly for drying sheets of paper wherein water vapor is removed which passes through the spiral-link fabric. Spiral-link fabrics have other industrial applications where they act as industrial conveyors and may be coated or otherwise impregnated with a resin depending upon the application.

In current practice, the above characteristics of the coils, i.e. the diameter of the monofilament forming the spiral fabric and the resultant width to thickness ratio, are dependently related. Bigger coils with relatively large width and higher thickness must be formed from a thicker monofilament, whereas monofilaments of a relatively small diameter can only form smaller coils. The use of bigger coils made from thicker monofilaments and heavier pintles result in heavier fabrics i.e. more weight per unit area, higher thickness and caliper, with a coarse hand and low number of contact points. In order to make a fabric more suitable for the dryer section and other "mark-sensitive" positions of the papermaking machine, a finer, lighter weight and thinner fabric with higher number of contact points and smaller contact points is desired. However, these fabrics require the smaller coils made from smaller monofilaments in order to achieve the required characteristics. The disadvantage being that more rows of coils, pintles and stuffers will be needed to make an equivalent fabric of the same weight per unit area.

Additionally, the production of spiral-link fabrics is labor-intensive. For example, spiral-link fabrics are constructed of many small spiral elements that must be coiled and assembled. The multiple manufacturing steps of coiling, interdigitating, and interconnecting spiral coils is labor intensive and requires come specialized machinery. In addition, it is difficult to interconnect the spiral coils because a pin, pintle or the like is inserted through small channels formed from the interdigitated spiral coils. Production time for such fabrics is compounded because the small width of the spiral coils requires a large number of pintles, as fabrics may be formed in a width of from 5 to over 33 feet in CD and a length of from 40 to over 400 feet. Further, the large number of pintles substantially covers the fabric resulting in a fabric that is stiff both in CD and diagonally across the MD during operation.

In addition, "stuffers" in the form of yams or the like are typically inserted within the inner space of each spiral coil to usually lower the permeability of the fabric. Currently, stuffers are pushed or stuffed into the inner space of each spiral coil one portion at a time using specialized machinery. As is to be appreciated, such stuffing method limits the material which may be used as stuffers because the stuffer must be sufficiently stiff or rigid to facilitate insertion into the small coil opening and across the full width of the fabric. Further, because the stuffers are pushed into the fabric, the process of inserting the stuffers may be slow and labor-intensive.

The present invention overcomes these shortcomings by providing a spiral-link fabric with wide spiral coils.

SUMMARY OF THE INVENTION

The inventor of the present invention has recognized that a spiral-link fabric having wide spiral coils of relatively low monofilament diameter to width ratio may overcome the shortcomings of the prior art.

Accordingly, an object of the present invention is to provide a spiral-link fabric whose spiral coils have relatively low monofilament diameter to coil width ratio.

Another object of the present invention is to provide a spiral-link fabric whose spiral coils have relatively low thickness to width ratio.

Yet another object of the present invention is to provide a spiral-link fabric whose spiral coils have a combination of relatively low thickness to width ratio and monofilament diameter to coil width ratio.

Accordingly, a spiral-link fabric for use in a papermaking machine or other industrial application is provided which may include a plurality of side-by-side spiral coils. The spiral coils may be interdigitated and interconnected by a series of parallel pintles extending through channels formed from the interdigitated spiral coils. Each spiral coil has a width of approximately 12 mm or larger as measured in the machine direction of the spiral-link fabric. The ratio of the monofilament diameter to the coil width can be about 0.07 or less. These types of spiral coils allow for versatility in selecting stuffers not heretofore realized, such that the stuffers may go beyond their traditional role involving effective fabric permeability.

The present invention offers significantly wider or larger width coils, while maintaining the smaller diameter of the monofilament and thickness, thereby needing fewer spiral coils to make a spiral-link fabric of equivalent weight per unit area.

An object of the invention is to use fewer coils and pintles as compared to the current spiral-link fabrics, but still offer the advantages of using small diameter monofilament such as smoother hand, lighter and thinner caliper fabrics.

A further object of the invention is to offer larger inside coil dimension or space in which either a less expensive and/or more functional stuffer can be used, because it can be pulled into the spiral-link fabric, instead of being pushed as is in current practice.

Yet another object of the invention is to provide larger width coils such that a lower number of coils are required to be stuffed with the stuffer yarn.

Yet another object of the invention is to provide a spiral-link fabric with wider coil pitch, such that if a wider coil pitch is spaced on the pintle, a more flexible spiral-link fabric may be produced.

The present invention will now be described in more complete detail with reference being made to the figures wherein like reference numerals denote like elements and parts, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

A preferred embodiment of the present invention will be described in the context of a papermaking dryer fabric. However, it should be noted that the present invention may be used in other sections of a papermachine, as well as in other industrial settings where spiral-link fabrics have heretofore found application as industrial fabrics.

Figure 1A:
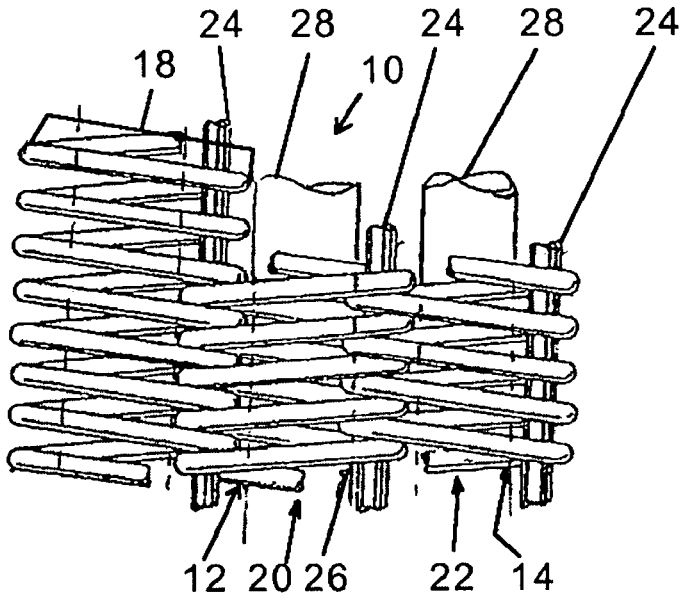
FIGS. 1*a* and 1*b* are views of a spiral-link fabric in accordance with an embodiment of the present invention.
Figure 1B:
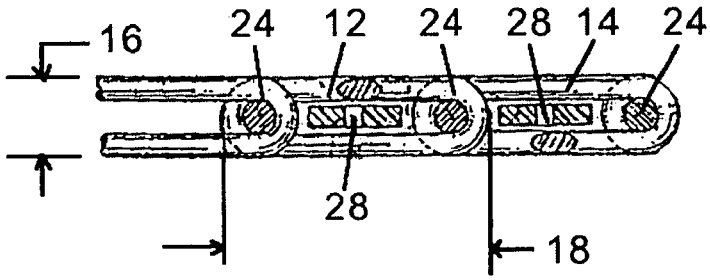

FIGS. 1*a* and 1*b* are views of a spiral-link fabric 10 in accordance with an embodiment of the present invention. Spiral-link fabric 10 may include a plurality of side-by-side spiral coils, such as coils 12 and 14, with each coil having a coil thickness and a coil width 18. Spiral coils 12 and 14 are substantially disposed in a direction transverse relative to the longitudinal axis of the fabric (which is along the running or machine direction ("MD") of the fabric). The turns of spiral coils 12 and 14 may be inclined in a predetermined manner. Spiral coils 12 and 14 are interdigitated and interconnected by a series of parallel or substantially parallel pintles or pins 24, or the like, extending through channels 26 formed from the interdigitated spiral coils 12 and 14. Further, stuffer inserts 28 may be inserted or otherwise disposed within openings 20 and 22 of spiral coils 12 or 14.

The present invention provides spiral coils 12 and 14 that are significantly wider than prior art designs. For example, coil width 18 may be from about 12 mm to 150 mm or about 0.5 to 6 inches, or larger. Further, spiral coils 12 and 14 may have a monofilament diameter to coil width 18 ratio of approximately 0.07 or less.

As an example of the present invention, spiral coils 12 and 14 may be round in cross section having a coil thickness 16 of 2.3 mm and a coil width 18 of 12 mm. Spiral coils 12 and 14 would then have a ratio of coil thickness 16 to coil width 18 of about 0.19. The monofilament forming the spiral coils may have a diameter of approximately 0.7 mm, resulting in spiral coils having a monofilament diameter to coil width 18 ratio of about 0.058. The following table shows examples of coils produced according to one embodiment of the invention, their coil thickness to width ratios and monofilament diameter to coil width ratios respectively.

| EXAMPLE | Coil width (mm) | Coil thickness (mm) | Coil thickness/ width ratio | Monofilament diameter (mm) | Monofilament diameter/Coil width ratio | Monofilament diameter/Coil thickness ratio | Pintle diameter (mm) |
|---|---|---|---|---|---|---|---|
| I | 12.00 | 2.30 | 0.19 | 0.70 | 0.058 | 0.304 | 0.90 |
| II | 150.00 | 3.30 | 0.02 | 1.00 | 0.007 | 0.303 | 1.00 |

It is to be noted that these values are purely exemplary and that the scope of the present invention is not limited to or confined to the above disclosed examples.

Further, spiral coils 12 and 14 may be formed of a polymer (such as polyester), metal or other material suitable for this purpose known to those so skilled in the art. As is appreciated, the starting yam or material, e.g., a monofilament, used to make the spiral coils 12 and 14 may be in various shapes. It may be, for example, round, rectangular, oval, or may be flattened, which shape may be determined by one of skill in the art on the basis of the ultimate use of the spiral-link fabric and the performance specifications required therefore. The monofilaments may have a diameter of, for example, 0.5 to 1.0 mm, or larger and the pintle yarns may have a diameter of approximately 0.1-1.0 mm or larger. Further, spiral coils 12 and 14 may be formed from a monofilament or multifilament material, which, if they are multifilament, may be treated or coated if necessary to ensure that the coils retain the ability to maintain their shape. The spiral coils 12 and 14 themselves may take on various shapes from, for example, round or helical to oval.

The wider spiral coils of the present invention provide advantages over current spiral-link fabric designs. For example, coil width 18 determines the number of coils per length of fabric. A wider coil means less coils or assemblies per length of fabric which may result in faster production of the fabric. Because the wider coils of the present invention may require fewer pintles to interconnect per length of fabric, the spiral fabrics may be easier to form and may require less labor and cost. Further, the wider spiral coils of the present invention may allow easy and quick installation of pintles 24 through channels 26. Accordingly, the present invention may effectively reduce the time and cost for manufacturing fabric 10.

Figure 2:
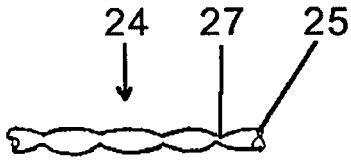
FIG. 2 is a diagram of a pintle usable in the present spiral-link fabric.

Pintle 24 may be pre-crimped or may have a stepped diameter. That is, the diameter of pintle may not be the same throughout its length. As shown in FIG. 2, first portion 25 has a first diameter and second portion 27 has a second diameter different than the first diameter. In this way, pintles 24 may provide wider coil spacing and use less material. It is also contemplated by the present invention that the pintles may alternatively have a non-round shape, and/or may be flexible or deformable under pressure. Accordingly, the spiral-link fabric 10 is flexible both in CD and diagonally across the MD during operation, and thus may conform to any misalignment that may occur with the support rolls that define the fabric run.

In addition, the spiral coils of the present invention, while functioning as the primary structural members of the fabric in all directions, also serve as carriers for stuffer inserts 28. For example, spiral coils 12 and 14 provide the fabric's MD strength and continuum as well as providing the "seam" or basis for becoming an endless belt. However, as the spiral coils of the present invention are wider than those of the prior art, and accordingly may accommodate larger stuffers than are possible in the prior art, it is also a facet of the present invention that the stuffers may also impart structural characteristics to the spiral-link fabric. For example, the composition of the stuffer inserts may alter the CD stiffness and the diagonal stress/strain of the spiral-link fabric. Accordingly, stuffer insert 28 may be designed to optimize fabric properties and characteristics.

Figure 3:
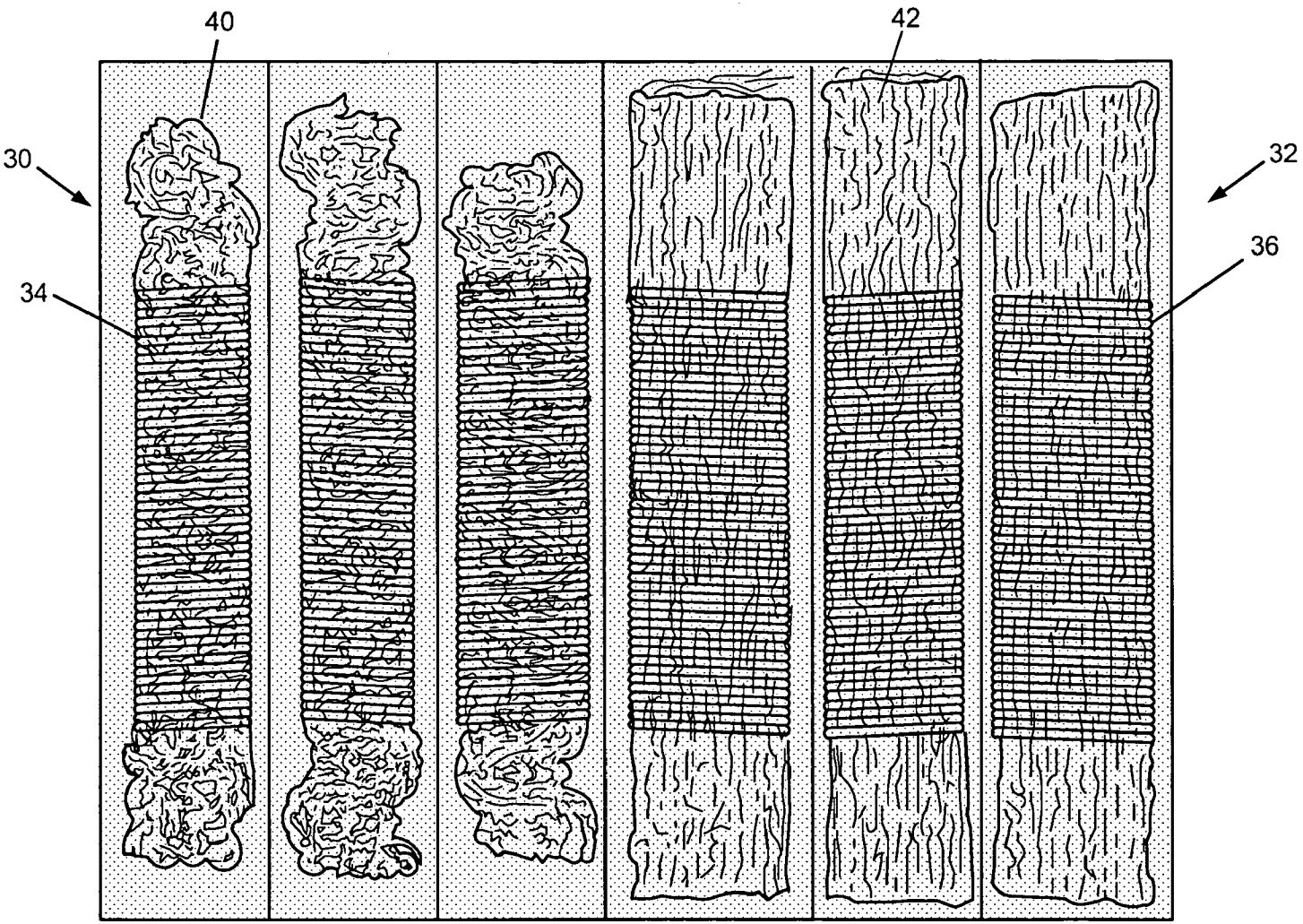
FIG. 3 is a photograph of one aspect of the spiral-link fabric with unique stuffer inserts.
Figure 4:
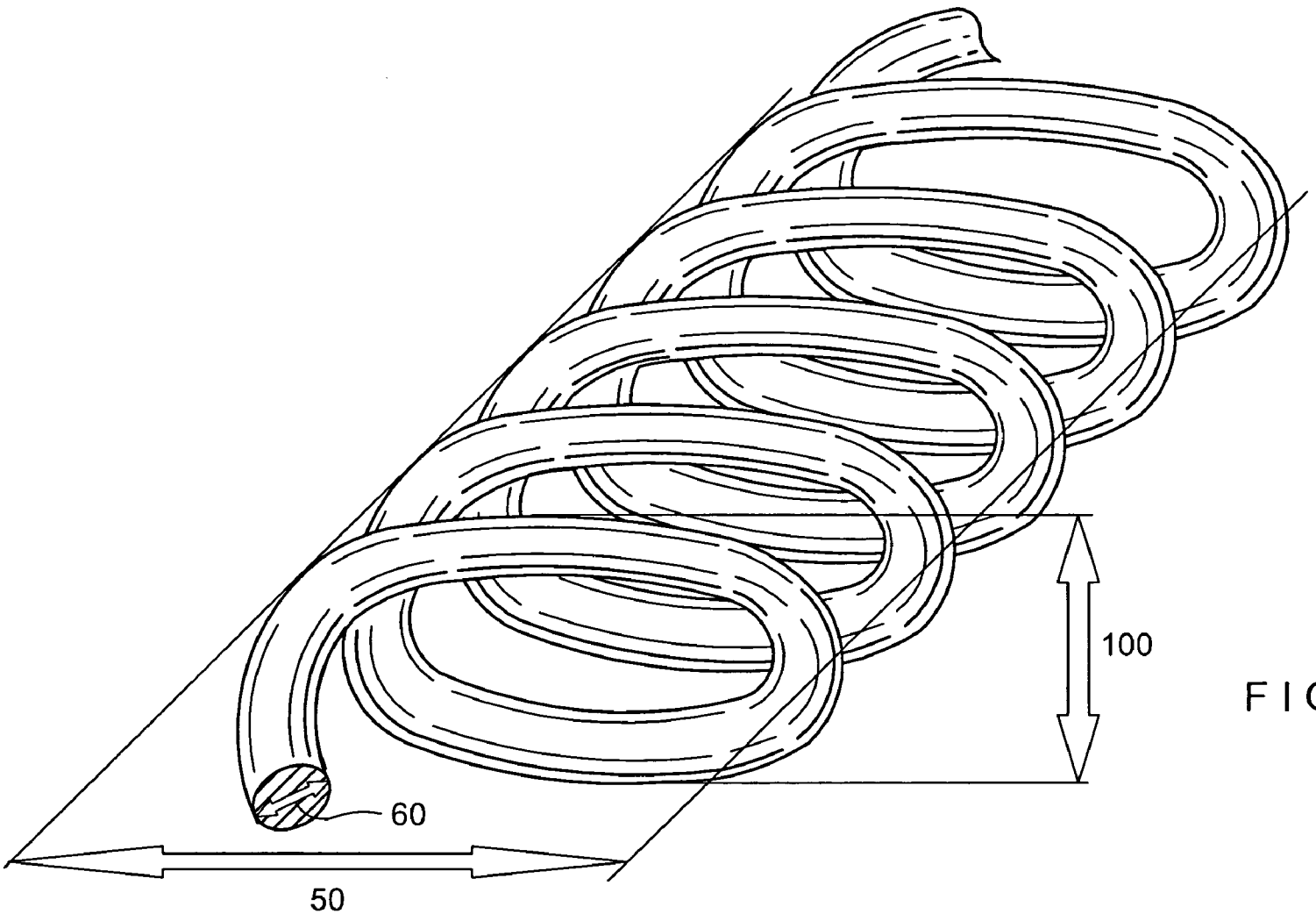
FIG. 4 is a view of a spiral coil in accordance with an embodiment of the present invention.

FIG. 3 is a photograph of side-by-side view of portions of two different spiral-link fabrics 30 and 32 in accordance with an embodiment of the present invention. As shown, fabrics 30 and 32 have relatively wide spiral coils 34 and 36 which provide inner spaces for insertion of stuffer inserts 40 and 42. Stuffer inserts 40 and 42 may be formed from one or more different materials, which may be rigid or flexible.

The stuffer inserts of the present invention may be formed from a material which is woven, knitted, or molded, or may be formed from extruded sheets of polymeric material or films, and may be continuous or formed from a number of discontinuous portions. In addition, the stuffer insert may be simply disposed within a spiral coil, or attached or fixed to the spiral coils. If fixed, the stuffer inserts may be fixed to adjacent spiral coils at its outer edges, centers of the spiral coils or at multiple points along the coils. The stuffer inserts may have grooves, ridges or so forth to facilitate their fixation to the coils. In addition, the stuffer insert may be stretched or relaxed to obtain a desired permeability or permeability profile for the fabric.

Further, the present invention includes stuffer inserts that are non-uniform in at least one dimension throughout the length of each individual stuffer. In many dryer sections, the sheet moisture profile is such that the sheet edges are drier than the center. A fabric that is more permeable in the center would contribute to flattening this unwanted non-uniform profile. For instance, in a spiral-link fabric of the present invention, a stuffer insert may have one effective diameter along its length at the ends or edges of the fabric and a second effective diameter at the fabric center. Effective diameter is a relative term to define the ability of both round and nonround cross section stuffers to affect the fabric characteristic desired.

The effective diameter of the stuffer near the fabric edges can be greater than that at the center of the fabric. This results in the spiral-link fabric to have edge areas with a lower permeability than the fabric center, so as to correct the sheet moisture profile. Of course, if the sheet profile is such that the edges are wet and the center is dry, a spiral-link fabric with stuffer inserts so designed as to make the center area less permeable than the fabric edges can also be constructed. Alternatively, various mechanical alterations of the stuffer, including but not limited to crimps, folds, perforations and the like may be distributed throughout the stuffer in either a uniform or non-uniform manner. Such a stuffer of the present invention may include a stuffer that has been "crimped" or "folded" in such a manner that the number of "crimps" or "folds" dispersed throughout the length of the stuffer varies. For example, a stuffer may have a larger number of "crimps" or "folds" dispersed throughout the ends of the stuffer than are present in the center of the stuffer.

As is to be appreciated, current stuffer designs must be sufficiently stiff and rigid so as to be able to be pushed into the small coil openings and across the full width of the spiral-link fabric. This typically involved the use of yarns. In contrast, the wide spiral coils of the present invention enable the stuffer inserts to be pulled through the spiral coils. The stuffer insert may be pulled by a rapier, gripper, or the like. In this way, the process to make the spiral-link fabric may be formed faster and may be less labor-intensive. Accordingly, the present invention may effectively reduce the time and cost for manufacturing a fabric. As is appreciated, there may be other ways of pulling the stuffer insert within the spiral coils of the present invention as known to those so skilled in the art.

Further, the stuffer inserts of the present invention may be formed of softer, more flexible and/or less expensive materials than prior art stuffers because the stuffer insert may now be pulled though the fabric instead of being pushed through. As a result, the inventive spiral-link fabric may be more flexible and less diagonally stiff than prior art spiral-link fabrics, improving the guiding and tracking of the fabric.

Thus, the present advantages are realized, and although preferred embodiments have been disclosed and described in detail herein, its scope and objects should not be limited thereby; rather its scope should be determined by that of the appended claims.

What is claimed is:

1. A spiral-link fabric for use in a papermaking machine comprising:

a plurality of spiral coils arranged in a predetermined manner such that adjacent ones of side-by-side spiral coils are interdigitated with each other so as to form a channel and interconnected by a pintle extending through the channel, wherein each spiral coil is formed from a yarn having a diameter, and wherein a ratio of the yarn diameter to coil width is 0.07 or less, and wherein at least some of the plurality of spiral coils have a coil width in the range of 12 mm or larger as measured in machine direction of the spiral-link fabric, and a flexible stuffer insert disposed within one or more spiral coils, wherein the flexible stuffer insert is pulled through the one or more spiral coils.

2. The spiral-link fabric of claim 1, wherein the yarn is a monofilament or multifilament which is coated.

3. The spiral-link fabric of claim 1, wherein the spiral coils are round, helical or oval in shape.

4. The spiral-link fabric of claim 1, wherein the pintle is selected from the group consisting of: round pintles, non-round pintles, pre-crimped pintles, and stepped diameter pintles.

5. The spiral-link fabric of claim 1, wherein the flexible stuffer insert comprises a material which is woven, knitted, or molded, or formed from extruded sheets of polymeric material or films.

6. The spiral-link fabric of claim 1, wherein the flexible stuffer insert is uniform or non-uniform in at least one dimension along its length.

7. The spiral-link fabric of claim 6, wherein the flexible stuffer insert has a varying effective diameter along its length.

8. The spiral-link fabric of claim 6, wherein the flexible stuffer insert has crimps, folds, and/or perforations distributed in a uniform or non-uniform manner throughout the length and/or diameter thereof.

9. The spiral-link fabric of claim 1, wherein the fabric has a variable permeability along its width.

10. The spiral-link fabric of claim 1, wherein the plurality of spiral coils have a coil width in the range of 12 mm to 150 mm.

11. The spiral-link fabric of claim 1, wherein the flexible stuffer insert has grooves or ridges on its surface.

12. The spiral-link fabric of claim 1, wherein the flexible stuffer insert is attached or fixed to the respective spiral coil.

13. The spiral-link fabric of claim 1, wherein the flexible stuffer insert is continuous or discontinuous.

14. A method of forming a spiral-link fabric for use in a papermaking machine comprising the steps of:

arranging a plurality of spiral coils in a predetermined manner such that adjacent ones of side-by-side spiral coils are interdigitated with each other so as to form a channel;

extending a pintle through each said channel formed from the interdigitated spiral coils, wherein each spiral coil is formed from a yarn having a diameter, and wherein a ratio of the yarn diameter to coil width is 0.07 or less, and wherein at least some of the plurality of spiral coils have a coil width in the range of 12 mm or larger as measured in machine direction of the spiral-link fabric; and inserting a flexible stuffer insert through at least one spiral coil, wherein the flexible stuffer insert is pulled through the at least one spiral coil.

15. The method of claim 14, wherein the flexible stuffer insert is pulled through the at least one spiral coil.

16. The method of claim 14, wherein the yarn is a monofilament or multifilament which is coated.

17. The method of claim 14, wherein the spiral coils are round, helical or oval in shape.

18. The method of claim 14, wherein the pintle is selected from the group consisting of: round pintles, non-round pintles, pre-crimped pintles, and stepped diameter pintles.

19. The method of claim 14, wherein the flexible stuffer insert comprises a material which is woven, knitted, or molded, or formed from extruded sheets of polymeric material or films.

20. The method of claim 14, wherein the flexible stuffer insert is uniform or non-uniform in at least one dimension along its length.

21. The method of claim 20, wherein the flexible stuffer insert has a varying effective diameter along its length.

22. The method of claim 20, wherein the flexible stuffer insert has crimps, folds, and/or perforations distributed in a uniform or non-uniform manner throughout the length and/or diameter thereof.

23. The method of claim 14, wherein the fabric has a variable permeability along its width.

24. The method of claim 14, wherein the plurality of spiral coils have a coil width in the range of 12 mm to 150 mm.

25. The method of claim 14, wherein the flexible stuffer insert has grooves or ridges on its surface.

26. The method of claim 14, wherein the flexible stuffer insert is attached or fixed to the respective spiral coil.

27. The method of claim 14, wherein the flexible stuffer insert is continuous or discontinuous.

* * * * *